US011161676B2

(12) United States Patent
Hermann et al.

(10) Patent No.: US 11,161,676 B2
(45) Date of Patent: Nov. 2, 2021

(54) BLISTER PACK

(71) Applicant: Amcor Flexibles Kreuzlingen Ltd., Kreuzlingen (CH)

(72) Inventors: Simone Hermann, Constance (DE); Peter Claessens, Gottmadingen (DE); Anna Perez, Barcelona (ES)

(73) Assignee: Amcor Flexibles Kreuzlingen Ltd., Kreuzlingen (CH)

( * ) Notice: Subject to any disclaimer, the term of this patent is extended or adjusted under 35 U.S.C. 154(b) by 230 days.

(21) Appl. No.: 16/328,494

(22) PCT Filed: Aug. 30, 2017

(86) PCT No.: PCT/EP2017/025246
§ 371 (c)(1),
(2) Date: Feb. 26, 2019

(87) PCT Pub. No.: WO2018/041415
PCT Pub. Date: Mar. 8, 2018

(65) Prior Publication Data

US 2019/0185244 A1 Jun. 20, 2019

(30) Foreign Application Priority Data

Aug. 30, 2016 (EP) ..... 16020318

(51) Int. Cl.
*B65D 75/36* (2006.01)
*B65D 81/32* (2006.01)
*B65D 75/32* (2006.01)

(52) U.S. Cl.
CPC ..... *B65D 81/3266* (2013.01); *B65D 75/327* (2013.01); *B65D 75/328* (2013.01); *B65D 2575/3245* (2013.01)

(58) Field of Classification Search
CPC .... B65D 25/00; B65D 25/2852; B65D 43/06; B65D 51/16; B65D 51/1688; B65D 83/04; B65D 83/0445; B65D 75/367; B65D 75/327; A61J 1/035; A61J 1/03; A61J 83/04
USPC ..... 220/214; 206/534.1, 528
See application file for complete search history.

(56) References Cited

U.S. PATENT DOCUMENTS 5,405,629 A * 4/1995 Marnocha ..... B65D 33/2533 206/466
2015/0283029 A1* 10/2015 Riis ..... A61J 1/035 206/438

FOREIGN PATENT DOCUMENTS

GB 2359044 A 8/2001
WO WO199312009 A1 6/1993
WO WO200164547 A1 9/2001

* cited by examiner

*Primary Examiner* — King M Chu
(74) *Attorney, Agent, or Firm* — Amcor Flexibles Kreuzlingen Ltd.

(57) ABSTRACT

The present invention relates to a blister pack that comprises a base laminate with a sealing layer and a lid laminate with a sealing layer, the base laminate having at least one cavity housing a product. The base laminate and the lid laminate are directly sealed to each other via their identical sealing layers whereby the seal comprises two different sealing subzones, a first sealing subzone providing a permanent seal and a second sealing subzone providing a peelable seal.

14 Claims, 7 Drawing Sheets

BLISTER PACK

The present invention relates to a blister pack for housing pharmaceutical products. A method for manufacturing such blister packs is also disclosed.

In medication, drug or dietary supplements blister packs are well known for packaging pharmaceutical products such as tablets, capsules, powders and liquids. Further, packages providing for a once-a-day regimen appear to be more effective than a multiple-doses-a-day regimen. Indeed, patients more readily follow a single daily medical administration than multiple daily medical administrations.

Multiple packaging combining different pharmaceutical compositions or dietary supplements are thus useful to ensure adherence to an optimal daily regimen.

However, combining and storing different pharmaceutical compositions or different components of a pharmaceutical composition in a common package is not simple as it may lead to undesired reactions or interactions between the chemical compounds present in the different compositions and/or supplements.

In particular, during storage a reaction between the bioactive substances in the formulation may occur, leading to degradation of one or more bioactive substances. Further, a bioactive substance may have a very limited stability when it is stored as aqueous solution, whereas when stored as lyophilized powder it possesses a much greater stability, such that no further freezing or cooling is necessary during storage. Degradation of one or more components or undesired reactions between different components may limit the combination of components in the final product, and/or the shelf life period of the product. It is thus challenging to decide on blending of substances in a final product and still keep good stability.

One possibility to avoid direct contact between different components or compositions may be achieved by packaging said components or compositions separately in different containers, such as bottles. This is, however, not convenient for patients and usually requires additional handling by the patient. The latter is prominent source of errors leading to an inefficient medication.

Hence, an improved blister package would be advantageous, and in particular, a blister package providing simple storage and facilitating convenient administration would be advantageous.

An object of the present invention is to provide a solution for holding different pharmaceutical components or compositions in a single use package. A further object of the invention is to provide a single use package that is able to hold different pharmaceutical components or compositions and that is easy to open.

Another object of the present invention is to provide an alternative to the prior art.

It is an object of the present invention to wholly or partly overcome the above disadvantages and drawbacks of the prior art.

The object is achieved by a blister pack according to the present invention as defined in claim 1. A method for manufacturing a blister pack according present invention is also provided as defined in claim 9. Further preferred embodiments are subject to the dependent claims.

A blister pack according to the present invention comprises a base laminate with a sealing layer and a lid laminate with a sealing layer. The base laminate has at least one cavity for housing a product. The base laminate and the lid laminate are sealed to each other via their sealing layers whereby the seal comprises two different sealing subzones, a first sealing subzone that provides a permanent seal and a second sealing subzone that provides a peelable seal.

In a further preferred embodiment a blister pack according to the present invention comprises a base laminate with a sealing layer and a lid laminate with a sealing layer. The base laminate has at least one cavity for housing a product. The base laminate and the lid laminate are directly sealed to each other via their identical sealing layers whereby the seal comprises two different sealing subzones, a first sealing subzone providing a permanent seal and a second sealing subzone providing a peelable seal. The sealing layer comprises a blend of polyethylene and of several functionalized ethylene copolymers.

The blister pack according to the present invention provides a simple possibility to achieve different sealing zones having different seal strength which allows forming peelable and permanent seals. There is no need to use different sealing materials as the different seals may be achieved with the blend of polyethylene and several functionalized ethylene copolymers.

In a further embodiment the base laminate has at least two cavities, a first cavity housing a first product, and a second cavity housing a second product. The first sealing subzone defines a sealed perimeter forming the closed blister pack whereas the second sealing subzone is internal to the first sealing subzone and at least partly separates the first and second cavity. The second sealing subzone is generally arranged between the at least two cavities in the form of a strip. However, different shapes of the second sealing subzone arranged between the cavities are also possible, e.g., an arched strip.

In another embodiment the second sealing subzone delaminates upon sustained manual pressure applied on one of the cavities. When the peelable seal provided by the second sealing subzone is broken by application of sustained manual pressure a communicating passage between the first and the second cavity is created which allows the mixture of the first and the second product.

In a further embodiment the first sealing subzone and the second sealing subzone define a sealed perimeter having a first end and a second end and two opposed sides forming the closed blister pack. The first sealing subzone is arranged at the second end and provides a peel stop and thereby prevents the complete separation of the lid laminate and the base laminate in an opened state of the blister pack.

In preferred embodiment the base laminate and the lid laminate comprise an identical sealing layer.

In another embodiment the sealing layer comprises a blend of polyethylene and several functionalized ethylene copolymers.

In a preferred embodiment the blend of the sealing layer comprises 10 to 80 weight percent polyethylene and 90 to 20 weight percent of functionalized ethylene copolymers.

The polyethylene component of the sealing layer preferably is a low density polyethylene, preferably having a density in the range of 0.921 g/cm$^3$ to 0.924 g/cm$^3$.

Blister pack according to claim 6, characterized in that the functionalized ethylene copolymers are copolymers of ethylene and an unsaturated comonomer having an organic functional group containing a carbon atom double bonded oxygen atom and being linked to an additional oxygen atom. Examples of such copolymers are ionomers, acrylic acid polymers, acrylic acid and methacrylic acid ester copolymers, and ethylene vinyl acetate copolymers.

In a preferred embodiment the functionalized ethylene copolymers, in particular the ionomers are derived from acid copolymers by partially neutralizing the acid moiety of the acid copolymer with a cation. A suitable synthesis is disclosed e.g. in U.S. Pat. No. 3,264,272. The preferred ionomers are sodium neutralized ionomers derived from at least (i) ethylene and (ii) acrylic acid or methacrylic acid and the zinc neutralized ionomers derived from at least (i) ethylene and (ii) acrylic acid or methacrylic acid and (iii) a monoethylenically unsaturated monomer as described in U.S. Pat. No. 5,891,500.

In another embodiment the ethylene acrylic acid copolymers (EAA) are non-cation neutralized copolymers synthesized from (i) ethylene and (ii) an acid comonomer (such as acrylic acid or methacrylic acid).

In another embodiment the acrylic and methacrylic ester copolymers (EMA, EBA) are copolymerized from (i) ethylene and (ii) non-symmetrically substituted ethylene in which the ester function contains an n-alkyl chain; and more specifically methyl in the case of EMA and n-butyl in the case of EBA.

In a further embodiment the functionalized ethylene copolymer is ethylene vinyl acetate copolymer having a vinyl acetate content of up to 30 weight percent based on the weight of the ethylene vinyl acetate copolymer. The ethylene vinyl acetate copolymers (EVA) with a vinyl acetate (VA) copolymer level up to 30% are typically prepared by high pressure radical copolymerization of (i) ethylene and (ii) vinyl acetate as diclosed in U.S. Pat. No. 5,135,988.

In another embodiment the blend of the sealing layer comprises ethylene functionalized copolymers selected from the group of ionomers, ethylene acrylic acid copolymer (EAA), ethylene butyl acrylate copolymer (EBA), ethylene methacrylic acid copolymer (EMA), and ethlyene vinyl acetate copolymer (EVA). A suitable ionomer is for instance the commercially available Surlyn® of Dupont.

In another embodiment the base laminate comprises three adhesively bonded layers, an outer layer of oriented polyamide, an optional primer layer, an intermediate layer of aluminum and an inner sealing layer made of a blend of polyethylene and several functionalized ethylene copolymers.

The base laminate may also comprise different multi-layer structures, it may comprise for instance additional intermediate layers either made of plastics or metal, metal alloys, e.g. aluminum and aluminum alloys. The intermediate layer may also comprise suitable plastics instead of metal and metal alloys. The outer layer of the base laminate may comprise oriented polyamide, oriented polypropylene, oriented polyethyleneterephtalat or further suitable plastics.

In a further embodiment of the blister pack the outer layer of the base laminate has a thickness in the range 10 μm to 40 μm, preferably 15 μm to 35 μm and more preferably 20 μm to 30 μm. The intermediate layer of the base laminate has thickness in the range of 30 μm to 60 μm, preferably 35 μm to 55 μm and more preferably 40 μm to 50 μm. Further, the inner sealing layer of the base laminate has a thickness in the range of 30 μm to 90 μm, preferably 40 μm to 80 μm and more preferably 50 μm to 70 μm.

In a further embodiment the lid laminate comprises of three adhesively bonded layers, an outer layer made of polyethylene terephthalate, an intermediate layer made of aluminium and an inner sealing layer made of a blend of polyethylene and several functionalized ethylene copolymers.

Other embodiments of the lid laminate wherein the lid laminate comprises additional layers are also conceivable. It may comprise multi-layer structures that made of adhesively bonded or coextruded plastics layers.

In yet another embodiment of the blister pack the outer layer of the lid laminate has a thickness in the range of 6 μm to 18 μm, preferably 8 μm to 16 μm and more preferably 10 μm to 14 μm. The intermediate layer of the lid laminate has thickness in the range of 10 μm to 30 μm, preferably 14 μm to 26 μm and more preferably 18 μm to 22 μm. Further, the inner sealing layer of the lid laminate has a thickness in the range of 30 μm to 90 μm, preferably 40 μm to 80 μm and more preferably 50 μm to 70 μm.

A method for manufacturing a blister pack according to the present invention comprises the step that the first sealing subzone is sealed at a first temperature and the second sealing subzone is sealed at a lower second temperature. The difference between the first sealing temperature and the second sealing temperature is at least 30° C., preferably 40° C. and more preferably 50° C.

In a further method for manufacturing a blister pack the first sealing subzone is sealed at a first temperature in the range of 170° C. to 200° C. and the second sealing subzone is sealed at a lower second temperature in the range of 110° C. to 140° C.

It is also possible to achieve the first and the second sealing subzone by sealing in two consecutive steps. In a first sealing step the base laminate and the lid laminate are sealed and form a peelable seal throughout the entire sealed area. That is, the second sealing subzone is formed in a first sealing step. In a subsequent sealing step those parts of the sealed area where a permanent seal is required are sealed a second time thereby achieving a permanent seal forming the first sealing subzone.

The method for forming packaging materials and the packaging materials according to the present invention are explained in more detail below with reference to exemplary embodiments in the drawings, in which, purely schematically:

Figure 1:
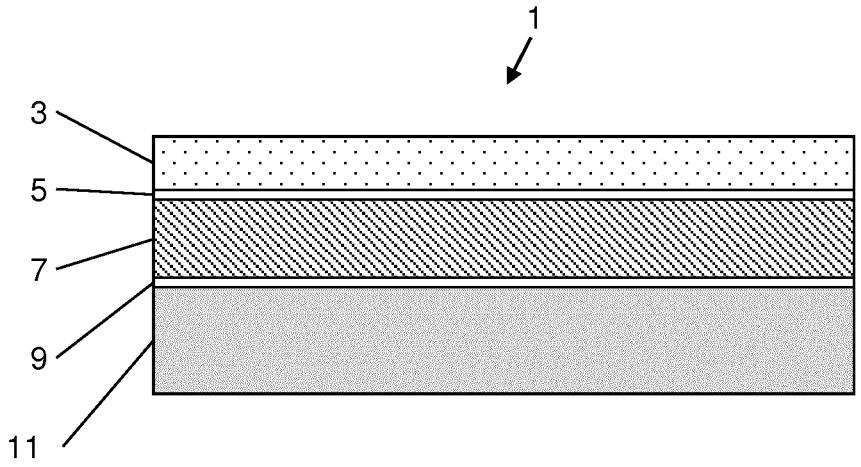
FIG. 1 shows a cross-sectional view of a base laminate according to the present invention.

FIG. 1 shows a cross-sectional view of a base laminate 1 according to the present invention. The base laminate 1 comprises three layers that are adhesively bonded. From outside to inside the layers are an outer layer 3, an intermediate layer 7 and an inner sealing layer 11. The three layers are adhesively bonded by interposed adhesive layers 5 and 9. The order of the layers from outside to inside means that the outer layer faces the outside of the blister pack whereas the inner sealing layer faces either the sealing layer of the respective lid laminate or alternatively a product space (not shown).

Figure 2:
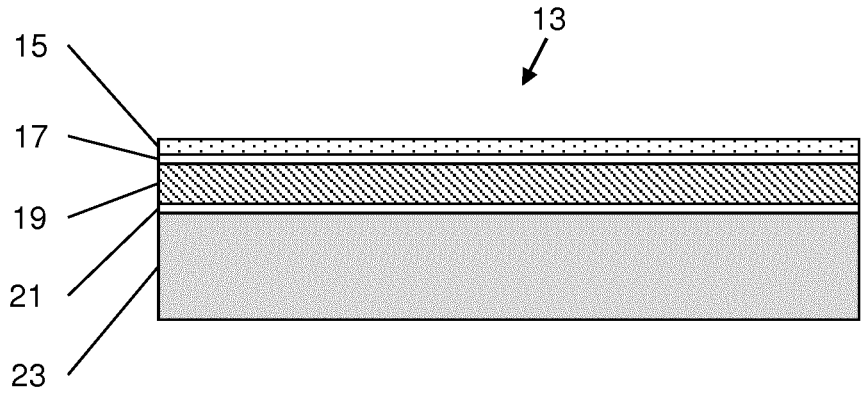
FIG. 2 shows a sectional view of a lid laminate according to the present invention.

FIG. 2 shows a cross-sectional view of a lid laminate 13 comprising the following layers, an outer layer 15, an intermediate layer 19 and an inner sealing layer 23. The three layers of the lid laminate 13 are also adhesively bonded by two interposed adhesive layers 17 and 21. Thus, adhesive layer 17 is interposed between the outer layer 15 and the intermediate layer 19. The adhesive layer 21 is interposed between the intermediate layer 19 and the inner sealing layer 23. Again, the order of layers is from outside to inside of the blister pack (not shown).

Figure 3:
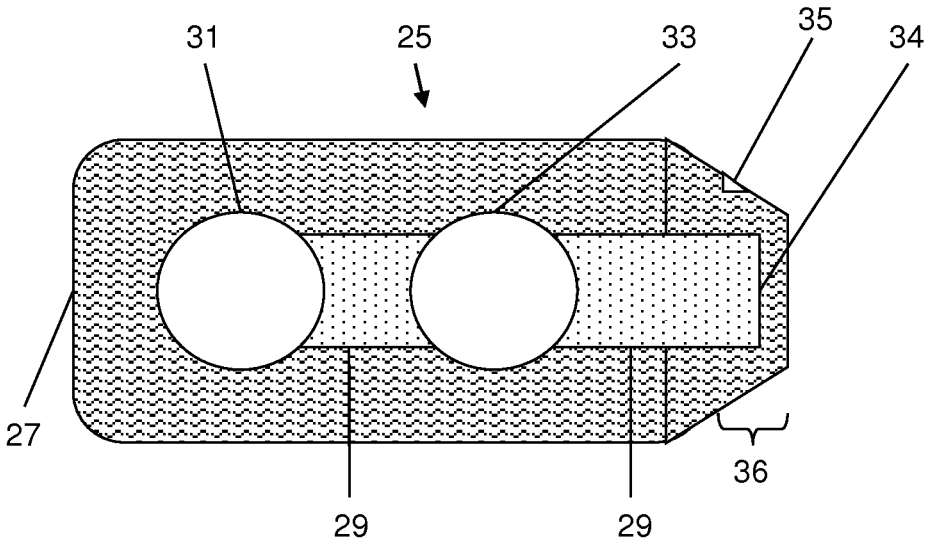
FIG. 3 shows a first embodiment of a blister pack according to the present invention.

FIG. 3 depicts a first embodiment of a blister pack according to the present invention. The figure shows a plan view of base laminate side of the blister pack 25. A first cavity 31 and a second cavity 33 housing two different products (not shown) are delimited by a first sealing subzone 27 and a second sealing subzone 29. While the first sealing subzone 27 provides a permanent seal, the second sealing subzone 29 provides for a peelable seal. The first sealing subzone 27 extends from the outer edges of the blister pack 25 to the boundaries of the cavities 31 and 33 as well as to the boundaries of the second sealing subzone 29. The first sealing subzone forms a circumferential permanent seal of the blister pack 25. The second sealing subzone 29 is arranged internal to the first sealing subzone 27. Said second sealing subzone 29 is further arranged between the first and second cavities 31 and 33. Another second sealing subzone 29 is arranged between the second cavity 33 and an outlet zone 34. Said outlet zone 34 becomes accessible when an end region 36 is torn off. The tearing action may be initiated at a notch 35 arranged at an outer edge of the blister pack 25.

Figure 4:
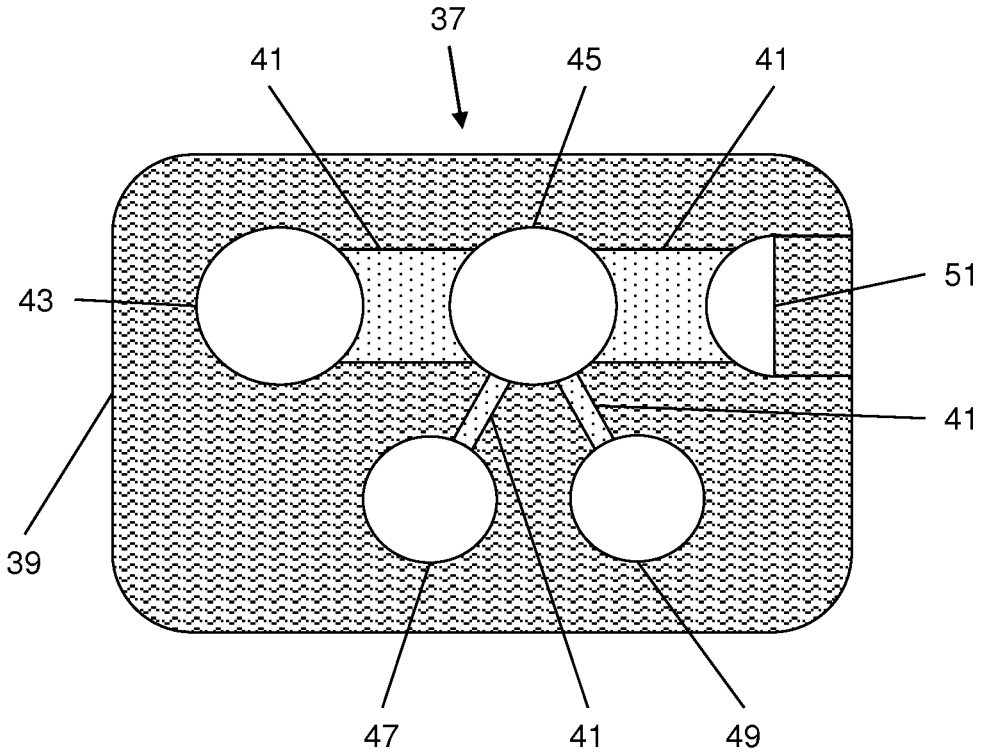
FIG. 4 shows a second embodiment of a blister pack according to the present invention.

FIG. 4 shows a second embodiment of a blister pack according to the present invention. Shown is again a plan view of the base laminate side of the blister pack 37. The blister pack 37 comprises four cavities 43, 45, 47 and 49. Said cavities may house up to four different products, e.g., different liquids or liquids and powders. The first sealing subzone 39 extends between the outer edge of the blister pack 37 and at least a part of the boundaries of the cavities 43, 45, 47 and 49. Between all of the four cavities 43, 45, 47 and 49 is a second sealing subzone 41 arranged in the form of a strip which upon being broken provides for a communicating passage with at least one other cavity. The cavity 45 is interconnected with all of the other three cavities 43, 47 49 by such a second sealing subzone 41. These second sealing subzones 41, arranged between the different cavities 43, 45, 47 and 49 have the form a strip of different width. Of course these second sealing subzone interconnecting the four cavities 43, 45, 47 and 49 may also have another shape, for instance a curved shape. The cavity 45 is further interconnected with an outlet 51 by a second sealing subzone 41 having a strip shape and providing a communicating passage between cavity 45 and the outlet zone 51 once the peelable seal of the respective second sealing subzone 41 is broken. The outlet zone 51 may comprise opening or withdrawal means allowing withdrawal of the composition comprising the products housed in the four cavities (not shown).

Figure 5:
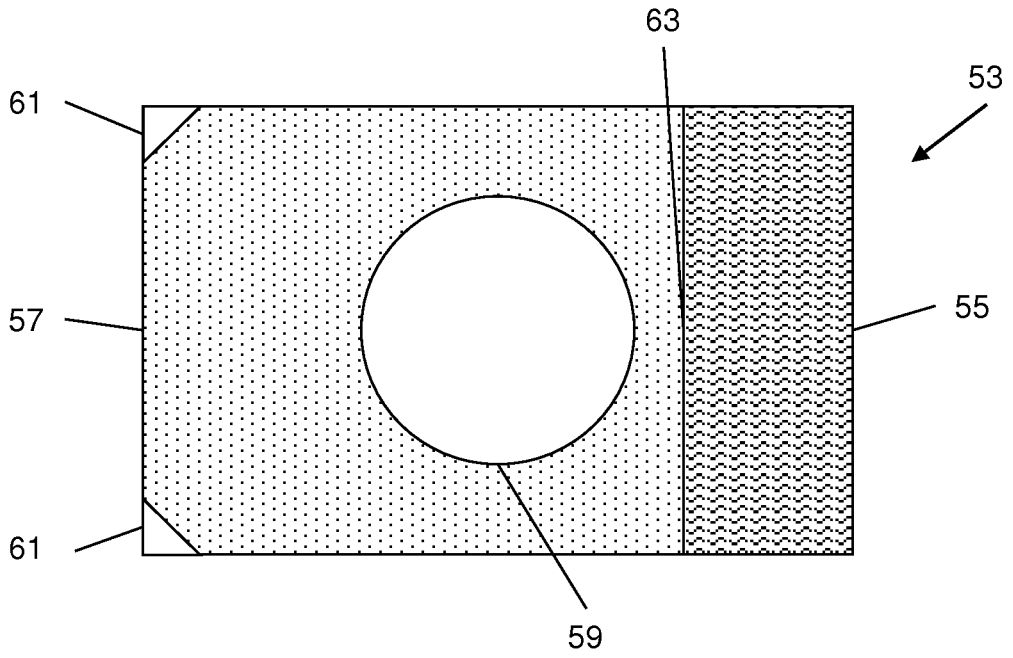
FIG. 5 shows a third embodiment of a blister pack according to the present invention.

FIG. 5 shows a third embodiment of a blister pack according to the present invention. The blister pack 53 has a rectangular shape. However, different shapes are also conceivable. The blister pack 53 comprises a cavity 59 housing a product, e.g. a powder (not shown), a first sealing subzone 55 and a second sealing subzone 57. The first sealing subzone 55 is arranged at one end of the blister pack 53. Adjacent to the first sealing subzone 55 the second sealing subzone 57 is arranged. This second sealing subzone 57 completely surrounds and delimits the cavity 59. At the end of the blister pack opposite to the end the first sealing subzone 55 is arranged at, there are triangular areas 61. In said areas 61 the base laminate and the lid laminate are not sealed to one another such that the lid laminate may be lifted and peeled off. A boundary line 63 delimiting the first sealing subzone 55 from the second sealing subzone 57 limits the extent to which the lid laminate may be peeled off. The first sealing subzone thus prevents that the lid laminate may be completely peeled of the base laminate.

Figure 6:
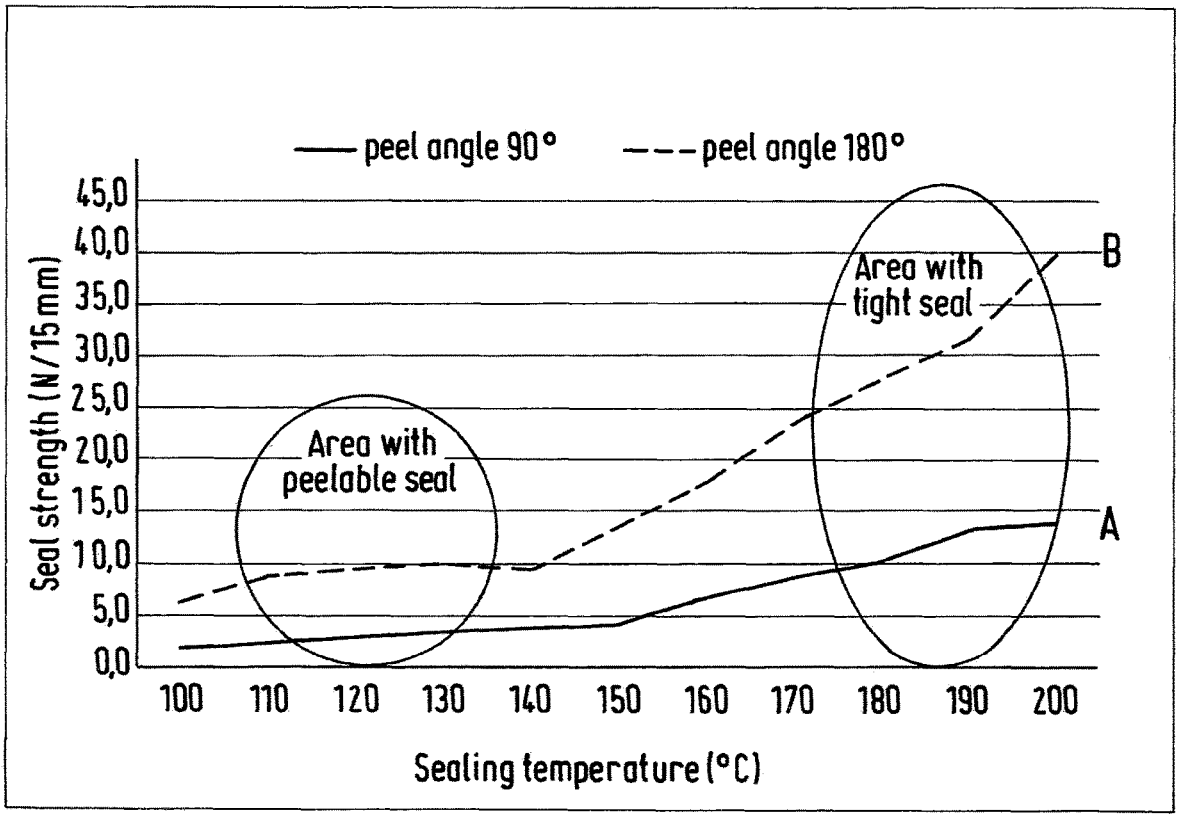
FIG. 6 shows a diagram illustrating the seal strength in dependence of the sealing temperature of a sealing layer according to the present invention.

FIG. 6 depicts a diagram illustrating the seal strength in dependence of the sealing temperature of a sealing layer according to the present invention. Curve A relates to a peel angle of 90° whereas in the case of curve B the peel angle is 180°. The dwell time during sealing was 1 s and the sealing pressure applied was 50 N/cm$^2$. The peel speed applied was 100 mm/min. Both curves show an extended sealing temperature range wherein the seal strength remains nearly constant between sealing temperatures from 110° C. to 140° C.

Figure 7:
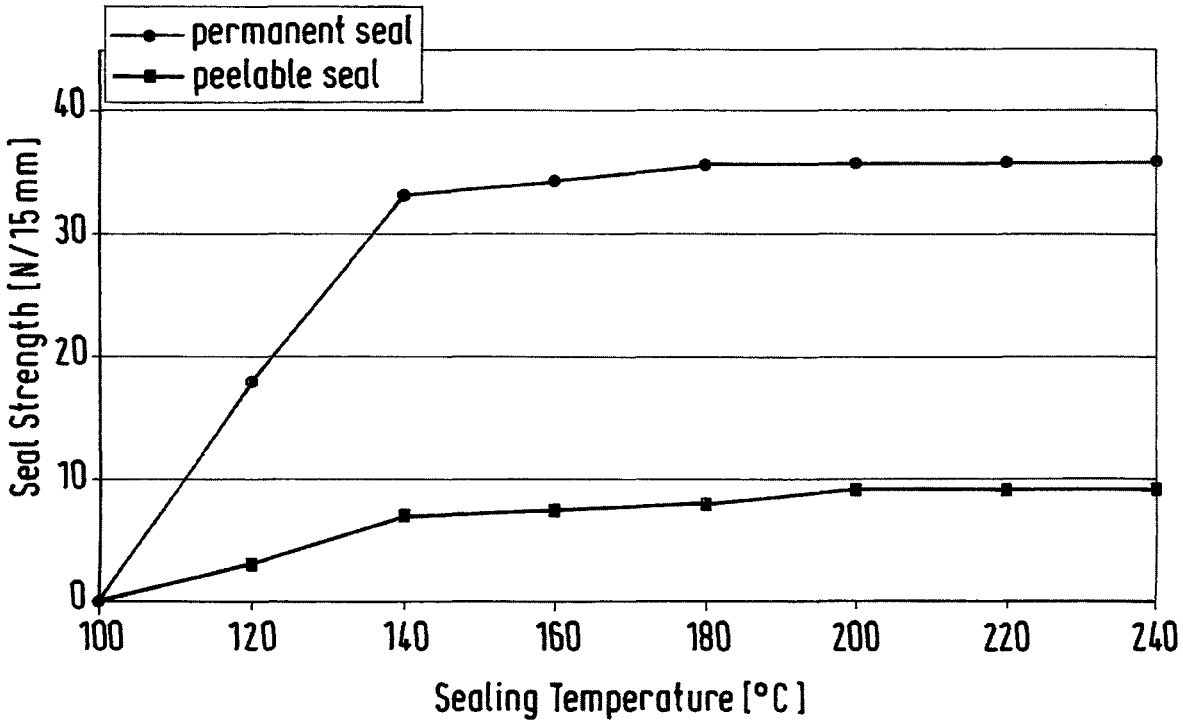
FIG. 7 shows a diagram illustrating the seal strength in dependence of the sealing temperature of polyethylene based sealing layers known in prior art.

FIG. 7 shows a diagram illustrating the seal strength in dependence of the sealing temperature for polyethylene sealing films known in prior art. While the lower seal strength curve (squares) illustrates the seal strength of a polyethylene film providing a peelable seal, the upper seal strength curve (circles, dashed line) illustrates the seal strength of a polyethylene film providing a permanent seal. The sealing device used is a Brugger, 10 mm, sealing time was 1 sec and the sealing pressure 600N. The seal strength has been tested on a Zwick, Parameter SS1, Tearing angle 180° C., n=2

The invention claimed is:

1. A blister pack comprising a base laminate with a sealing layer and a lid laminate with a sealing layer, the base laminate having at least two cavities, a first cavity housing a first product, and a second cavity housing a second product, whereby the base laminate and the lid laminate are directly sealed to each other via their sealing layers characterized in that the seal comprises two different sealing subzones, a first sealing subzone providing a permanent seal and a second sealing subzone providing a peelable seal, the first sealing subzone defining a sealed perimeter forming the closed blister pack, the second sealing subzone being internal to the first sealing subzone and at least partly separating the first and second cavity.

2. Blister pack according to claim 1, characterized in that the second sealing subzone delaminates upon sustained manual pressure applied on one of the cavities, thereby providing a communicating passage between the first and the second cavity allowing the mixture of the first and the second product.

3. Blister pack according to claim 1, characterized in that the first sealing subzone and the second sealing subzone define a sealed perimeter having a first end and a second end and two opposed sides forming the closed blister pack, whereby the first sealing subzone is arranged at the second end providing a peel stop and thereby preventing complete separation of the lid laminate and the base laminate in an opened state of the blister pack.

4. Blister pack according to claim 1, characterized in that the base laminate and the lid laminate comprise an identical sealing layer.

5. Blister pack according to claim 1, characterized in that the lid laminate sealing layer comprises a blend of polyethylene and several functionalized ethylene copolymers.

6. Blister pack according to claim 5, characterized in that the polyethylene is a low density polyethylene having a density in the range of 0.921 g/cm$^3$ to 0.924 g/cm$^3$.

7. Blister pack according to claim 5, characterized in that the functionalized ethylene copolymers are copolymers of ethylene and an unsaturated co-monomer having an organic functional group containing a carbon atom double bonded oxygen atom and being linked to an additional oxygen atom.

8. Blister pack according to claim 5, characterized in that the functionalized ethylene copolymers are derived from acid copolymers by partially neutralizing the acid moiety of the acid copolymer with a cation.

9. Blister pack according to claim 5, characterized in that the functionalized ethylene copolymers are ethylene acrylic acid copolymers and are non-cation neutralized copolymers derived from ethylene and an acrylic acid comonomer, preferably acrylic acid or methacrylic acid.

10. Blister pack according to claim 5, characterized in that the functionalized ethylene copolymer is ethylene vinyl acetate copolymer having a vinyl acetate content of up to 30 weight percent based on the weight of the ethylene vinyl acetate copolymer.

11. Blister pack according to claim 1, characterized in that the base laminate comprises three adhesively bonded layers, an outer layer of oriented polyamide, an intermediate layer of aluminium, an inner sealing layer made of a blend of ethylene acrylic acid and an ionomer resin, and an optional primer layer.

12. Blister pack according to claim 11, characterized in that the outer layer of the base laminate has a thickness in the range of 10 μm to 40 μm, the intermediate layer of the base laminate has thickness in the range of 30 μm to 60 μm, and the inner sealing layer of the base laminate has a thickness in the range of 30 μm to 90 μm.

13. Blister pack according to claim 1, characterized in that the lid laminate consists of three adhesively bonded layers, an outer layer made of polyethylene terephthalate, an intermediate layer made of aluminium and an inner sealing layer made of a blend of ethylene acrylic acid and an ionomer resin.

14. Blister pack according to claim 13, characterized in that the outer layer of the lid laminate has a thickness in the range of 6 μm to 18 μm, the intermediate layer of the lid laminate has thickness in the range of 10 μm to 30 μm, and the inner sealing layer of the lid laminate has a thickness in the range of 30 μm to 90 μm.

* * * * *